US009376880B2

(12) United States Patent
Stimpfle-Ziegler

(10) Patent No.: US 9,376,880 B2
(45) Date of Patent: Jun. 28, 2016

(54) DRILLING DEVICE AND METHOD FOR PRODUCING A BOREHOLE

(71) Applicant: BAUER MASCHINEN GMBH, Schrobenhausen (DE)

(72) Inventor: Andreas Stimpfle-Ziegler, Aichach (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 255 days.

(21) Appl. No.: 14/094,486

(22) Filed: Dec. 2, 2013

(65) Prior Publication Data

US 2014/0151126 A1 Jun. 5, 2014

(30) Foreign Application Priority Data

Dec. 4, 2012 (EP) ..... 12008107

(51) Int. Cl.

| | |
|---|---|
| ***E21B 27/04*** | (2006.01) |
| ***E21B 3/00*** | (2006.01) |
| ***E21B 7/00*** | (2006.01) |
| ***E21B 10/44*** | (2006.01) |

(52) U.S. Cl.

CPC . *E21B 27/04* (2013.01); *E21B 3/00* (2013.01); *E21B 7/006* (2013.01); *E21B 10/44* (2013.01)

(58) Field of Classification Search

CPC ..... E21B 10/44; E21B 7/006; E21B 27/04
See application file for complete search history.

(56) References Cited

U.S. PATENT DOCUMENTS

| | | | | | |
|---|---|---|---|---|---|
| 521,175 | A | * | 6/1894 | Odewahn | E21B 7/006 175/242 |
| 2,116,359 | A | * | 5/1938 | McCann | E21B 7/006 175/262 |
| 2,245,750 | A | | 6/1941 | Betts | |
| 2,529,246 | A | * | 11/1950 | Detrick | E21B 7/006 173/36 |
| 2,810,553 | A | * | 10/1957 | Bigelow | E21B 10/44 175/310 |
| 2,873,950 | A | * | 2/1959 | Kandle | E21B 4/18 173/141 |
| 2,915,288 | A | * | 12/1959 | Crapez | E02D 7/28 173/109 |
| 3,232,361 | A | | 2/1966 | Haspert | |
| 3,420,320 | A | * | 1/1969 | Hiro | E02D 5/385 173/196 |
| 4,854,404 | A | * | 8/1989 | Weber | E21B 7/003 172/111 |

(Continued)

FOREIGN PATENT DOCUMENTS

| | | |
|---|---|---|
| DE | 29612342 U1 | 9/1996 |
| DE | 10219757 C1 | 7/2003 |

(Continued)

OTHER PUBLICATIONS

The European search report issued on Apr. 23, 2013, which corresponds to EP12008107.0 and is related to U.S. Appl. No. 14/094,486.

*Primary Examiner* — Shane Bomar
(74) *Attorney, Agent, or Firm* — Studebaker & Brackett PC

(57) ABSTRACT

The invention relates to a drilling device for producing a borehole in the ground with a drilling tool driven in a rotating manner for removing ground material and a container for receiving the removed ground material, wherein the container has a lower feed opening, through which the removed ground material can be introduced into the container. It is envisaged that the drilling tool comprises at least one drill flight arranged below the container and that in an inlet area to the container between the drill flight and the feed opening an inlet section is provided, the pitch of which is increased with respect to a pitch of the drill flight.

9 Claims, 2 Drawing Sheets

(56) References Cited

U.S. PATENT DOCUMENTS

Figure 1:
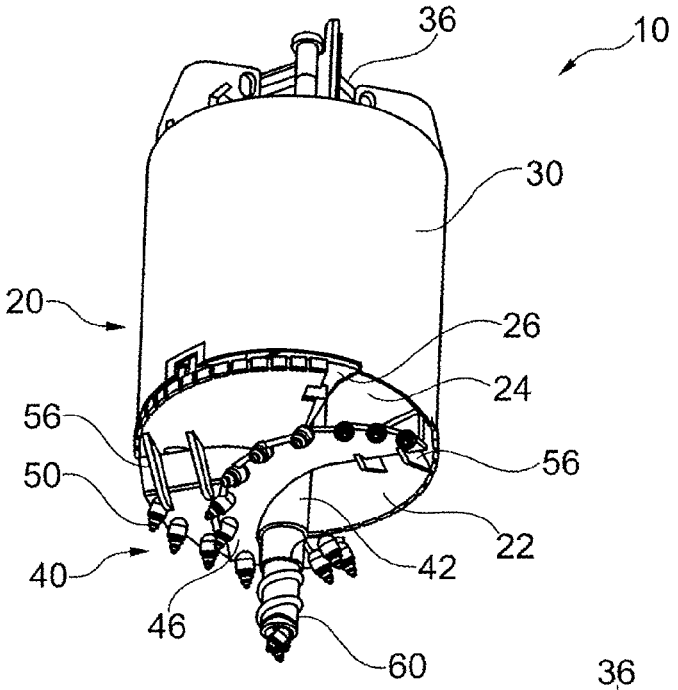

| | | | | | |
|---|---|---|---|---|---|
| 5,366,029 | A * | 11/1994 | Beck, III | E21B 7/28 | 175/344 |
| 5,394,949 | A * | 3/1995 | Wright | E21B 7/006 | 175/121 |
| 5,431,238 | A | 7/1995 | Trevisani | | |
| 7,090,038 | B2 * | 8/2006 | Lee | E21B 4/10 | 175/267 |
| 8,615,906 | B2 * | 12/2013 | Matthias | E02F 3/407 | 175/316 |
| 2005/0241859 | A1 | 11/2005 | Lee | | |
| 2006/0060386 | A1 | 3/2006 | Reich | | |
| 2013/0269220 | A1 * | 10/2013 | Matthias | E21B 27/00 | 37/189 |

FOREIGN PATENT DOCUMENTS

| | | | | |
|---|---|---|---|---|
| DE | 202004004799 | U1 | 5/2004 | |
| EP | 0628700 | A2 | 12/1994 | |
| EP | 1640507 | A1 | 3/2006 | |
| GB | 306354 | A * | 2/1929 | E21B 7/006 |

* cited by examiner

DRILLING DEVICE AND METHOD FOR PRODUCING A BOREHOLE

The invention relates to a drilling device as well as to a method for producing a borehole in the ground.

The drilling device comprises a drilling tool driven in a rotating manner for removing ground material and a container for receiving the removed ground material. The container has a lower feed opening, through which the removed ground material can be introduced into the container.

Known drilling devices with a container for receiving the loosened material, so-called drilling buckets, are not suitable for drilling hard stone or rock, since the known drilling tools designed for hard stone or rock do not ensure a reliable conveyance of the ground material into the container. Hence, in order to drill hard stone it has been necessary up until now to initially make use of a separate drilling tool, with which an existing rock layer can be ripped open for example. Following a tool change, the loosened material is then conveyed by means of the container. Thus, a tool change is always necessary to loosen the material at first and to convey it afterwards with the container or drilling bucket out of the borehole.

To drill hard stone so-called conical tapered augers are known for example. These have a drilling auger which tapers in the drilling direction and on which a plurality of drilling teeth is arranged. In order to loosen hard stone conical tapered augers have a comparatively small flight pitch.

When employing conical tapered augers the problem exists, on the one hand, that in the case of dry drilling operations loosened parts of rock only remain on the auger flights with great difficulty. On the other hand, those parts of rock that do remain are frequently flushed down during extraction of the tool in the case of fluid-supported drilling operations. To convey the loosened ground material out of the borehole separate devices with a drilling bucket are therefore used.

A combination of drilling bucket and conical tapered auger could not as yet be implemented due to the low flight pitch and the resultant problems with regard to the opening on the container.

A drilling device with a container for receiving removed ground material is described, for example, in DE 102 19 757 C1. Another drilling bucket can be taken from EP 1 640 507 A1.

DE 20 2004 004 799 U1 describes an auger with a drill flight tapering in the drilling direction. A further conical tapered auger is described in DE 296 12 342 U1.

The invention is based on the object to provide a drilling device and a method for producing a borehole in the ground, which enable a particularly efficient production of the borehole especially in the case of hard ground conditions.

The invention relates to a drilling device as well as to a method for producing a borehole in the ground.

The drilling device stated above is developed further in accordance with the invention in that the drilling tool has at least one drill flight which is arranged below the container and has removal tools, in particular drilling teeth, and that in an inlet area to the container between the drill flight and the feed opening an inlet section is provided, the pitch of which is increased with respect to a pitch of the drill flight.

The method for producing a borehole is carried out with a drilling device according to the invention.

A first fundamental idea of the invention resides in the combination of a drilling bucket, i.e. a drilling device with a container for receiving the removed ground material, and a drill flight arranged below the container for removing the ground material.

The combination of drilling auger and container or drilling bucket is rendered possible in accordance with the invention in that between the drill flight, which usually has a low flight pitch, and the feed opening of the container a flight section is provided that has an increased pitch as compared to the drill flight. As a result of this steep transition between flight and container the loosened ground material can be reliably transported into the drilling bucket despite the low pitch of the drill flight. Moreover, due to the inclined inlet surface the axial distance between the uppermost (perhaps single) turn of the drill flight and the bottom of the drilling bucket is enlarged. This reduces the risk of collision of larger pieces of rock with the bottom of the drilling bucket and therefore a clogging of the feed opening. Furthermore, the dimension of the feed opening of the container bottom can be restricted to a reasonable measure. The drilling device according to the invention is especially suitable for diameters of one meter or more.

According to the invention it is preferred that the drill flight is designed in a tapering manner in the drilling direction and that on an outer edge removal tools are arranged. Such a drill flight, which can also be referred to as a conical tapered auger, is especially suitable for removing hard stone. A conical tapered auger comprises a drill flight, which widens in a direction opposed to the drilling direction or tapers down in the drilling direction and is equipped with a plurality of drilling tools in the form of drilling teeth or drilling chisels. The drill flight has a spirally running outer edge. Due to the tapering drill flight the outer edge forms a conical helix in particular.

As a result of the combination of drill flight and receiving container for the removed material a particularly efficient drilling method can be realized especially in the case of hard stone. The hard ground material is loosened by means of the conical tapered auger, which is especially suitable for this purpose, and conveyed via the drill flight in the upward direction towards the container. By means of the container arranged above the conical tapered auger the material can be conveyed in particular in a discontinuous manner in the upward direction out of the borehole.

Especially in the case of larger drilling diameters it is preferred that the drill flight is designed as a multiple helix, in particular as a double helix, and that on the container two or more feed openings are designed accordingly. The use of two or more drill flight plates or a multiple helix enables an automatic centering of the drilling tool in the borehole.

Easy emptying of the container outside the borehole can be achieved in that the drill flight is fixed on a container bottom which is linked in a pivotable or rotatable manner to the container. Thus, the drill flight can be pivoted together with the container bottom, allowing the drill spoil received in the container to be discharged freely.

An improved centering of the drilling tool in the borehole can be achieved in that a centering shaft preceding the drill flight in the drilling direction is provided, which comprises at least one frontal removal tool. The centering shaft can comprise a shaft base body, around which a helical groove and/or a flight extend. The centering shaft, which is of cylindrical shape in particular, preferably extends in the axial extension of a holding shaft, around which the drill flight is arranged, and preferably has a length that corresponds at least 20%, particularly preferred at least 30%, to the axial length of the holding shaft of the drill flight. On a lower front face of the centering shaft at least one removal tool, in particular a drilling tooth or chisel is arranged. By preference, several removal tools are placed eccentrically on the front face of the centering shaft and positioned obliquely in the direction of rotation of the centering shaft.

The removal tools on the drill flight are preferably arranged by projecting radially with respect to the outer edge of the drill flight. By preference, the removal tools, which can be designed as drilling teeth or chisels in particular, are positioned obliquely with respect to the drilling direction, with their drill bit or chisel tip pointing obliquely in the direction of rotation of the drill flight.

The drill flight is preferably connected in a torque-proof manner to the container and can be driven in a rotating manner together with the container. To this end, a holding shaft is preferably fixed on the container bottom, on the outer circumference of which the drill flight is arranged.

At an upper end of the container a connection means for connecting a drill rod is preferably provided. By means of the drill rod the container can be driven in a rotating manner. Via the container the drill flight connected thereto in a torque-proof manner is driven too.

By preference, the feed opening of the container is closable. For this purpose, a slide closure can be provided for example which can be moved transversely to the drilling direction and by means of which the feed opening can be closed. The bottom of the container preferably comprises a base element, which is linked in a pivotable manner to the container base body about an axis located transversely to the drilling direction, and a slide closure which can be moved in parallel to the base element in order to open and close the feed opening at the bottom of the container. In a preferred embodiment the slide closure is supported in a rotatable manner about a central axis of the container that preferably constitutes the drilling axis. The opening and closing of the slide closure can be implemented with a suitable drive mechanism.

Especially good stability of the device is achieved in that the inlet section in the inlet area to the container is supported by way of at least one support plate. Due to the increased pitch of the inlet section as compared to the subjacent drill flight the inlet area is exposed to comparatively large forces. In order to deflect these effectively one or several support plates that deflect the forces are arranged in the rear area of the inlet section or below the inlet section. By preference, the support plates extend transversely to a conveying surface of the inlet section and are supported on the one hand on the inlet section and on the other hand on the container bottom.

With the method according to the invention the advantages set out in conjunction with the drilling device are achieved.

Figure 2:
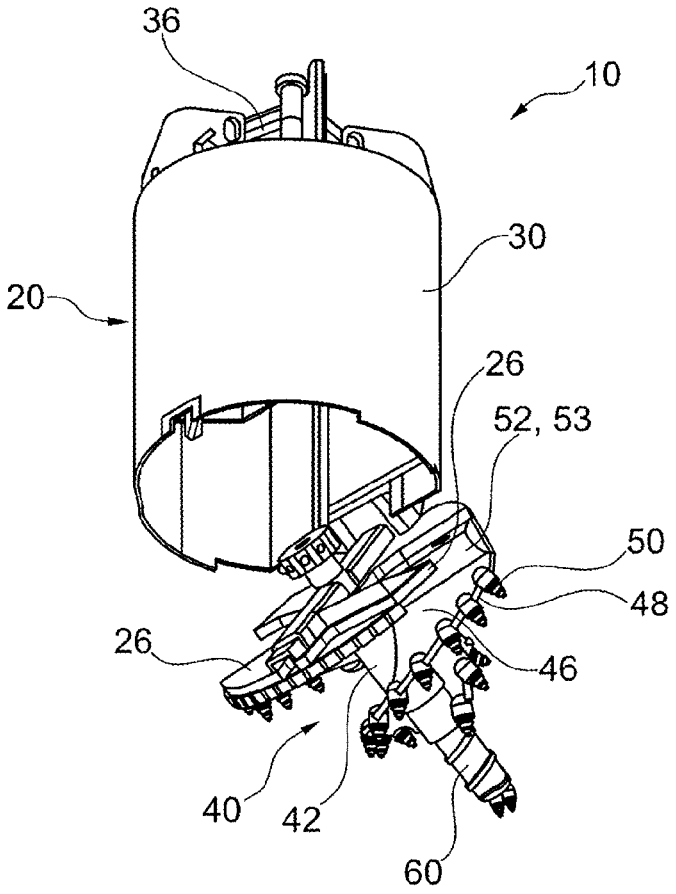
Figure 3:
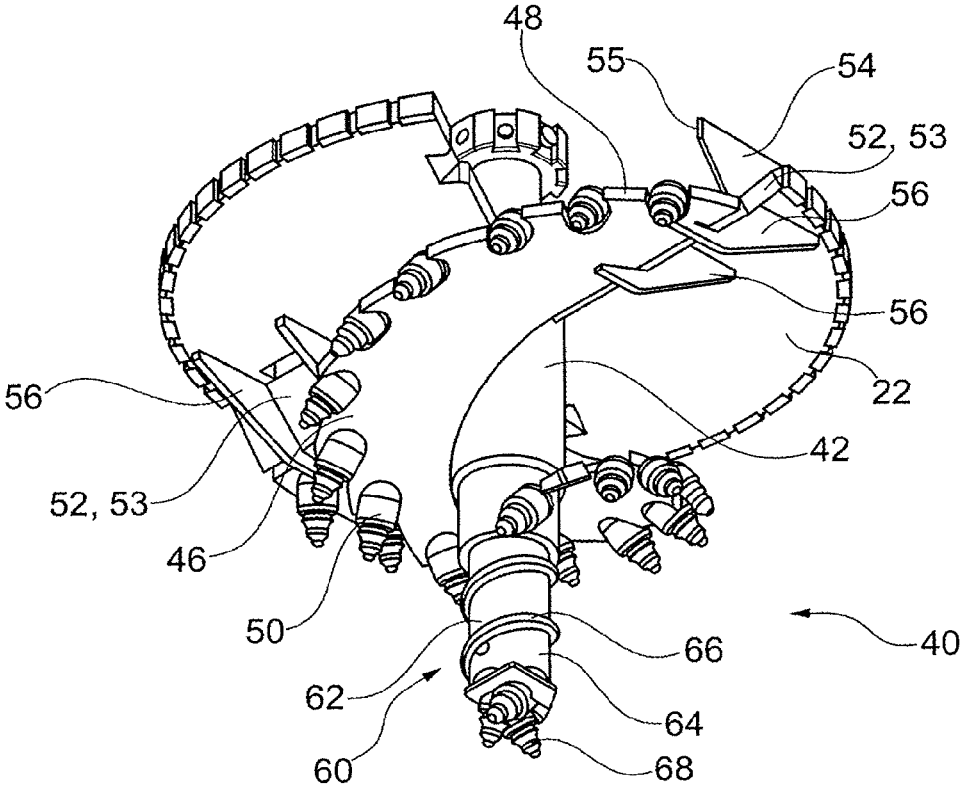

In the following the invention is described further by way of preferred embodiments illustrated in the accompanying schematic Figures, wherein shows:

FIG. 1 a perspective view of a drilling device according to the invention with closed container bottom;

FIG. 2 the drilling device according to FIG. 1 with open container bottom;

FIG. 3 a perspective view of a container bottom according to the invention with conical tapered auger; and FIG. 4 a view from below of the container bottom with conical tapered auger from FIG. 3.

Identical elements or those having the same effect are marked in all Figures with the same reference signs.

A drilling device 10 according to the invention is illustrated in FIGS. 1 and 2. The drilling device 10 comprises a container 20 for receiving removed or loosened ground material. Below the container 20, which can also be referred to as a drilling bucket, a drilling tool 40 is arranged, which can also be referred to as a conical tapered auger. The drilling tool 40 comprises a central holding shaft 42 which extends centrally below the container 20 in the drilling direction. Around the holding shaft 42 two drill flight plates 47 of a drill flight 46 designed as a double helix are arranged. Basically, provision can also be made for only one drill flight plate 47 or more than two drill flight plates 47 to be arranged. The drill flights 46 or drill flight plates 47 taper radially in the drilling direction, i.e. the radial extension decreases in the drilling direction. On an outer edge 48 of the drill flights 46 removal tools 50 in the form of drilling teeth are arranged that are designed for loosening ground material, in particular stone or rock.

By means of the drilling teeth arranged along the drill flight 46 ground material is loosened. The loosened ground material is conveyed via the drill flight 46, which has a first pitch, towards the container 20. The container 20 comprises a container bottom 22, in which a feed opening 24 is designed, through which the loosened ground material can be introduced into the container 20. The feed opening 24 can be closed with a slide closure 26.

The drilling tool 40 with its drill flight 46 and the drilling teeth or chisels fixed thereon is designed in particular for stone or rock and accordingly has a pitch suitable for this purpose. To introduce the ground material into the container 20 an inlet section 52 is provided above the drill flight 46, which has a larger pitch than the drill flight 46.

The drill flight 46 with the first pitch leads as far as to below the feed opening 24. In the area below the feed opening 24 the transition to the inlet section 52 is located. The inlet section 52 solely extends below the feed opening 24 of the container bottom 22. It forms a conveying section for conveying the removed ground material from the drill flight 46 to the feed opening 24 and has, in particular, a constant pitch that is increased with respect to the drill flight 46.

The inlet section 52 comprises an inlet plate 53 between the drill flight 46 and the container bottom 22, in particular between an upper end area of the drill flight 46 and an inlet edge of the container bottom 22 on the border of the feed opening 24.

Due to the inlet section 52 with increased pitch the conveyed drill spoil receives an impulse in the axial direction, i.e. along the drilling axis. To improve the stability of the drilling tool 40 the inlet plate 53 is supported on its underside and rear side by one or several support plates 56. The support plates 56 deflect the forces acting on the inlet plate 53 into the container bottom 22.

The container bottom 22 is pivotably supported on a container base body, in particular on a cylindrical wall 30 of the container 20. The container bottom 22 can be pivoted together with the drilling tool 40 out of the drilling axis so that the container 20 can be emptied outside the borehole.

At an upper end of the container 20 a connection means 36 is provided, to which a drill rod can be connected for driving the container 20 in a rotating manner and/or for applying an axial feed force. The connection means 36 can be designed in particular as a so-called Kelly box.

Figure 4:
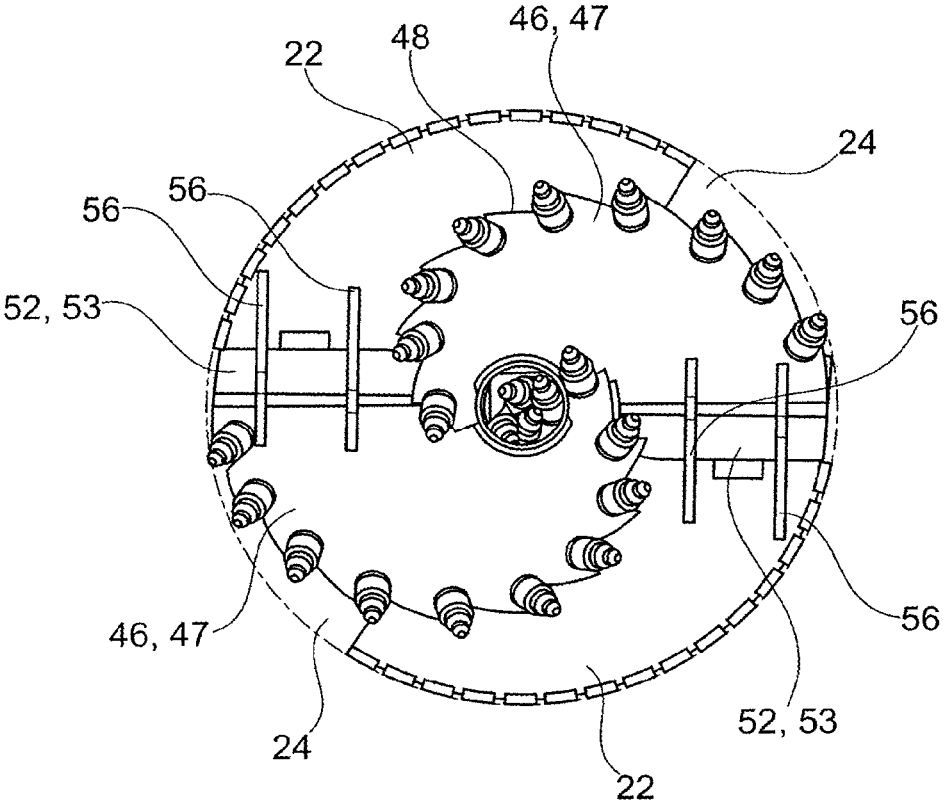

FIGS. 3 and 4 show the container bottom 22 with the drilling tool 40 firmly attached thereto in a manner independent of the container base body. As can be clearly seen in the Figures, below the drill flight 46 the drilling tool 40 comprises a centering shaft 60 which runs in the extension of the holding shaft 42 and can basically be designed integrally with the latter. On an outer circumference of the centering shaft 60 conveyor flights 66 having a radial depth of a few millimeters or centimeters extend around a shaft base body 62. Between the flights 62 helical grooves 64 are formed, through which ground material can be conveyed upwards. This facilitates screwing of the centering shaft 60 into the ground. The flights 66 have a constant radius along the shaft base body 62. On an underside of the shaft base body 62 one or several removal tools 68 are located, which can be designed in particular for removing hard stone and can be referred to as pilot bits.

From FIG. 4 it can be taken that when viewing the drilling tool 40 from below, the removal tools 50 or drilling teeth extend along the drill flight 46 or the respective drill flight plate 47 along an approximate involute or a logarithmic or hyperbolic spiral. Each drill flight plate 47 extends across less than one turn, in particular approximately a half-turn. At the inlet section 52 the drill flight 46 reaches the diameter of the container 20. The inlet section 52 is designed without removal tools.

In accordance with the number of drill flight plates 47 the container 20 has one or several feed openings 24. The feed openings 24 extend axially above a partial section of the drill flights 46 and above the inlet section 52. On the outer edge of the inlet section 52, along the circumference of the drilling device 10, a guide plate 54 can be arranged in order to reliably convey the ground material into the container 20. The guide plate 54 can be provided with a crushing edge 55 that can extend obliquely downwards in particular.

The invention claimed is:

1. Drilling device for producing a borehole in the ground with a drilling tool driven in a rotating manner for removing ground material and a container for receiving the removed ground material, wherein the container has a lower feed opening, through which the removed ground material can be introduced into the container, the drilling tool has at least one drill flight which is arranged below the container and has a plurality of removal tools, in an inlet area to the container between the drill flight and the feed opening an inlet section is provided, the pitch of which is increased with respect to a pitch of the drill flight, the drill flight is fixed on a container bottom which is linked in a pivotable manner to the container such that the drill flight is pivotable together with the container bottom, the drill flight is designed in a tapering manner in the drilling direction as a conical tapered auger, on an outer edge of the drill flight, the plurality of removal tools are arranged on a conical helix, the conical helix is extending from the outer diameter of the container bottom to a centering shaft, and the drill flight is designed to reach the outer diameter of the container at the inlet section.

2. Drilling device according to claim 1, wherein the drill flight is designed as a multiple helix, in particular as a double helix, and on the container two or more feed openings are designed accordingly.

3. Drilling device according to claim 1, wherein a centering shaft preceding the drill flight in the drilling direction is provided, which comprises a frontal removal tool and at least one helical groove extending around a shaft base body and/or a conveyor flight.

4. Drilling device according to claim 1, wherein the removal tools project radially with respect to the outer edge of the drill flight.

5. Drilling device according to claim 1, wherein the drill flight is connected in a torque-proof manner to the container and can be driven in a rotating manner together with the container.

6. Drilling device according to claim 1, wherein at an upper end of the container a connection means for connecting a drill rod is provided.

7. Drilling device according to claims 1, wherein the feed opening of the container is closable.

8. Drilling device according to claim 1, wherein the inlet section in the inlet area to the container is supported by way of at least one support plate.

9. Method for producing a borehole in the ground with a drilling device according to claim 1.

* * * * *